US005778535A

United States Patent [19]

Ledesma

[11] Patent Number: 5,778,535

[45] Date of Patent: Jul. 14, 1998

[54] MULTIWIDTH HAND RAZOR

[76] Inventor: Jesus C. Ledesma, 5406 Greenview Rd., Cary, Ill. 60013

[21] Appl. No.: 825,392

[22] Filed: Mar. 28, 1997

[51] Int. Cl.[6] ..... B26B 21/06

[52] U.S. Cl. ..... 30/50; 30/346.57

[58] Field of Search ..... 30/47–50, 346.57, 30/34.1, 32

[56] References Cited

U.S. PATENT DOCUMENTS

| | | | |
|---|---|---|---|
| 3,430,341 | 3/1969 | Choate . | |
| 3,648,365 | 3/1972 | Iten et al. . | |
| 3,849,882 | 11/1974 | Ferraro | 30/50 X |
| 4,285,124 | 8/1981 | Diakonov | 30/50 X |
| 4,461,078 | 7/1984 | Carreker | 30/50 X |
| 4,599,793 | 7/1986 | Iten . | |
| 4,831,731 | 5/1989 | Eltis . | |
| 5,402,574 | 4/1995 | Milner | 30/50 X |
| 5,469,621 | 11/1995 | Alsept et al. . | |
| 5,666,729 | 9/1997 | Ferraro | 30/346.57 X |

*Primary Examiner*—Douglas D. Watts
*Attorney, Agent, or Firm*—Terrance L. Siemens

[57] ABSTRACT

A hand held razor configured to provide a cutting pattern suitable for penetrating into and cleanly shaving corners and similar areas of a person's face providing restricted access to razors. The razor has a head holding three blades disposed in parallel, spaced apart relation occupying a single plane, and a handle. The head and handle generally form a tee. The three blades are of different lengths, and are held centered on the head in order of progressively increasing length, with the shortest blade disposed at the bottom of the head. The right and left ends of the blades define respective straight lines arranged at thirty degree angles to the axis of the handle.

4 Claims, 2 Drawing Sheets

MULTIWIDTH HAND RAZOR

BACKGROUND OF THE INVENTION

1. Field of the Invention

The present invention relates to a hand razor having a plurality of blades. More particularly, each blade is of a different length than that of the others. The blades are arranged on a holder so as to cut swaths of different widths. The novel hand razor is thus able to penetrate into areas of the face of limited width. This enables a person to maneuver around retained hair, such as mustaches and beards, while still enabling shaving exposed skin.

2. Description of the Prior Art

Men having beards and mustaches which are limited in the area of the face they cover are difficult to maintain in a neat condition since the surrounding facial skin must periodically be shaved. Natural configurations of beards and mustaches leave small areas of exposed skin which must be shaved. However, commercially available razors typically have blades of such lengths as to render the delicate task of shaving around beards and mustaches difficult at best.

The problem is that while the effective width of most razors, as determined by blade length, enables rapid and efficient shaving of broad, open skin surfaces, these razors are ill designed for detailed work in close quarters. A smaller or narrower razor could be provided to enable detail work. This approach is seen in U.S. Pat. No. 5,469,621, issued to Mark A. Alsept et al. on Nov. 28, 1995. However, the subject razor of this patent is inefficient in shaving broad areas. Unlike the device of Alsept et al., the present invention combines both broad and narrow blades to enable both detail work and also efficient shaving of large surface areas of skin.

Many arrangements of multibladed razors have been proposed in the prior art. Examples are seen in U.S. Pat. Nos. 3,430,341, issued to William M. Choate on Mar. 4, 1969, 3,648,365, issued to Clemens A. Itens et al. on Mar. 14, 1972, 4,599,793, issued to Clemens A. Itens on Jul. 15, 1986, and 4,831,731, issued to Mirel Eltis on May 23, 1989. None of these prior art inventions provides plural cutting blades of different cutting swath widths, all disposed in a common plane so as to be able to cut simultaneously during a single pass, as seen in the present invention.

None of the above inventions and patents, taken either singly or in combination, is seen to describe the instant invention as claimed.

SUMMARY OF THE INVENTION

The present invention provides a hand held razor having an elongated handle and a blade carrying head affixed to one end of the handle. The head carries a plurality of cutting blades arranged in order of descending length.

The novel razor can penetrate into areas of the face which offer restricted access to conventional razors. When the uppermost blade encounters an area too narrow to permit further shaving, the lowermost blade has passed the point of the uppermost blade, thereby entering into a corner of exposed skin of the user's face which is inaccessible to razor blades of standard width.

At the same time, the uppermost, full length blade enables shaving of broad expanses of the face to be performed with the same razor. If a razor of reduced length is provided, as taught by Alsept et al., then efficient, rapid shaving requires a razor of standard width in addition to that employed for detail work. The present invention enables shaving to be performed with a single razor, while still offering the ability to penetrate narrow exposed skin surfaces of the face.

Preferably, the novel razor includes three blades arranged parallel and spaced apart, occupying a common plane in order of progressively increasing blade length, with the longest blade at the top of the head of the razor. The shortest blade is located towards the bottom of the head, so that the razor may be pulled in conventional fashion for shaving.

The lengths and alignment of the blades is such that the right ends of the blades collectively occupy a line forming a thirty degree angle with the handle. The left ends are correspondingly arranged in mirror image relationship. This relationship is felt to result in optimum spacing and progressive narrowing of the blades resulting in maximal convenience and comfort to the user.

The three blades are centered with respect to the handle of the razor, so that the user may intuitively direct the narrowest blade and the overall shaving pattern by assuming alignment between the blades and the handle. This feature is particularly important when direct observation of the cut is not possible, even if a mirror is used.

Accordingly, it is a principal object of the invention to provide a razor capable of entering and shaving surface areas of a person's face which are too narrow to admit standard razors.

It is another object of the invention to provide ability to shave areas of limited access as well as to shave broad expanses of the face efficiently with a single razor.

It is a further object of the invention to provide convenient, comfortable spacing of plural blades of a razor, enabling intuitive recognition of blade position.

Still another object of the invention is to center the several blades with respect to the handle of the razor.

An additional object of the invention is to locate the shortest blade at the bottom of the head of the razor, so that the razor may be pulled in conventional fashion when being used.

It is again an object of the invention to arrange the blades in order of progressively increasing blade length, with the longest blade at the top of the head of the razor.

Yet another object of the invention is that the ends of the blades define two lines each disposed at a thirty degree angle to the handle of the razor.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
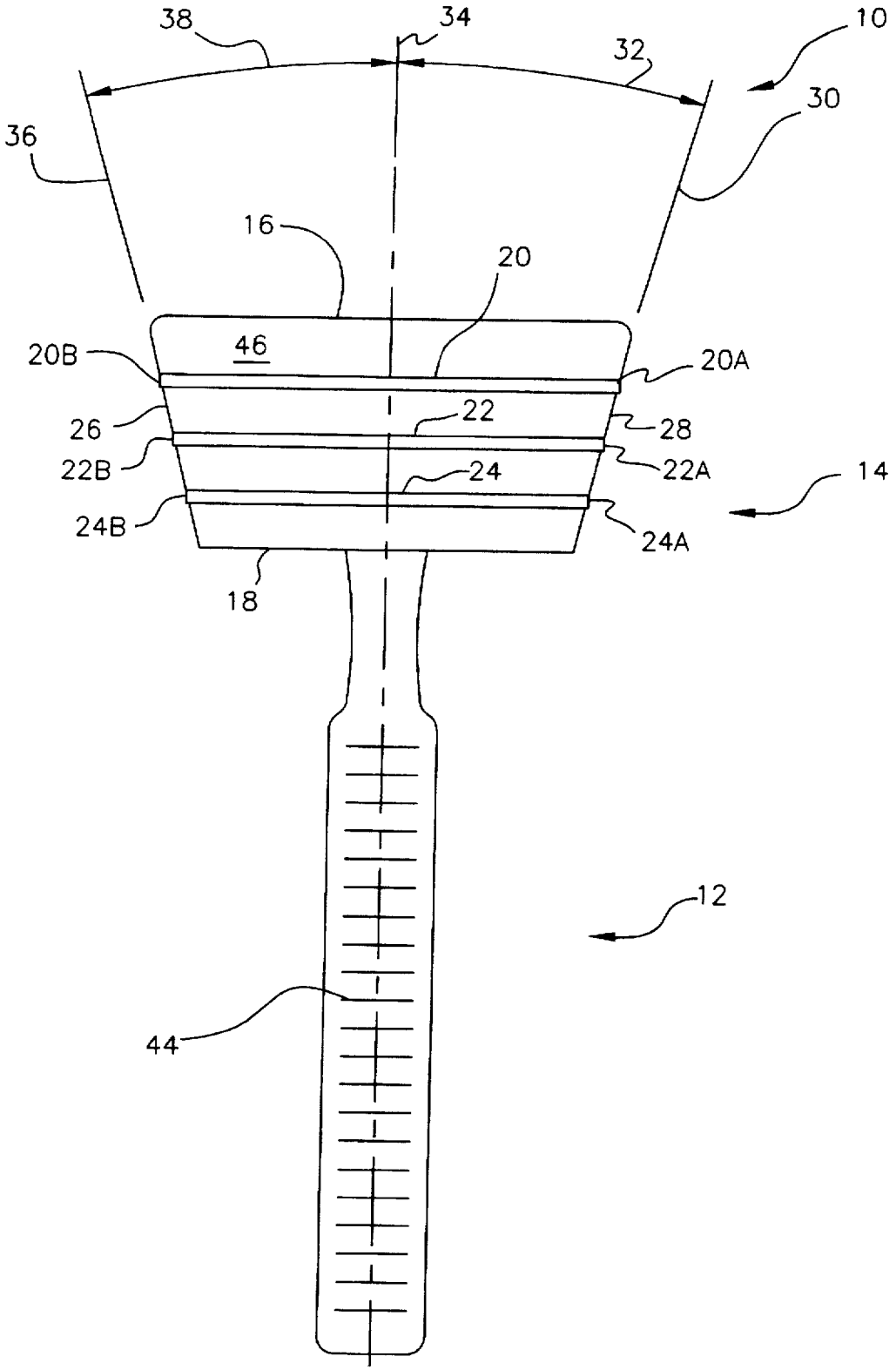
FIG. 1 is a front elevational view of the invention.

Novel hand held razor 10 is seen in FIG. 1 to comprise an elongated handle 12 and a head 14 having top and bottom surfaces 16, 18. Three blades 20, 22, 24 are held within head 14 by entrapment within the structure of head 14. The three blades are held in parallel, spaced apart relationship occupying a common plane.

Blades 20, 22, 24 are each of length different from that of the others. As used herein, length is that dimension from left lateral surface 26 to right lateral surface 28 of head 14. The length of each blade 20, 22, or 24 corresponds to the width of head 14 at each blade 20, 22, or 24. Blades 20, 22, 24 are held within head 14 in order of progressively increasing blade length, with the shortest blade 24 disposed proximate bottom surface 18 of head 14.

Respective right ends 20A, 22A, 24A of blades 20, 22, and 24 are aligned in a straight line, indicated by projection line 30. Line 30 forms an included angle 32 of thirty degrees with respect to axis 34 of handle 12. Head 14 is constructed in mirror image fashion about axis 34, so that left ends 20B, 22B, 24B of blades 20, 22, 24 also are aligned in a straight line, shown at 36. A corresponding included angle 38 of thirty degrees exists between line 36 and axis 34.

Projection lines 30 and 36 form a vee, with blades 20, 22, and 24 being centered within head 14 of razor 10. This bilateral symmetry and consequent centering of blades 20, 22, 24 within razor 10 and equidistant spacing of blades 20, 22, 24 from the adjacent neighbor of each assist in enabling a user to grasp intuitively the location of razor 10 on his face while using the same. Therefore, full direct or mirrored view of the work while shaving is not absolutely necessary.

Figure 2:
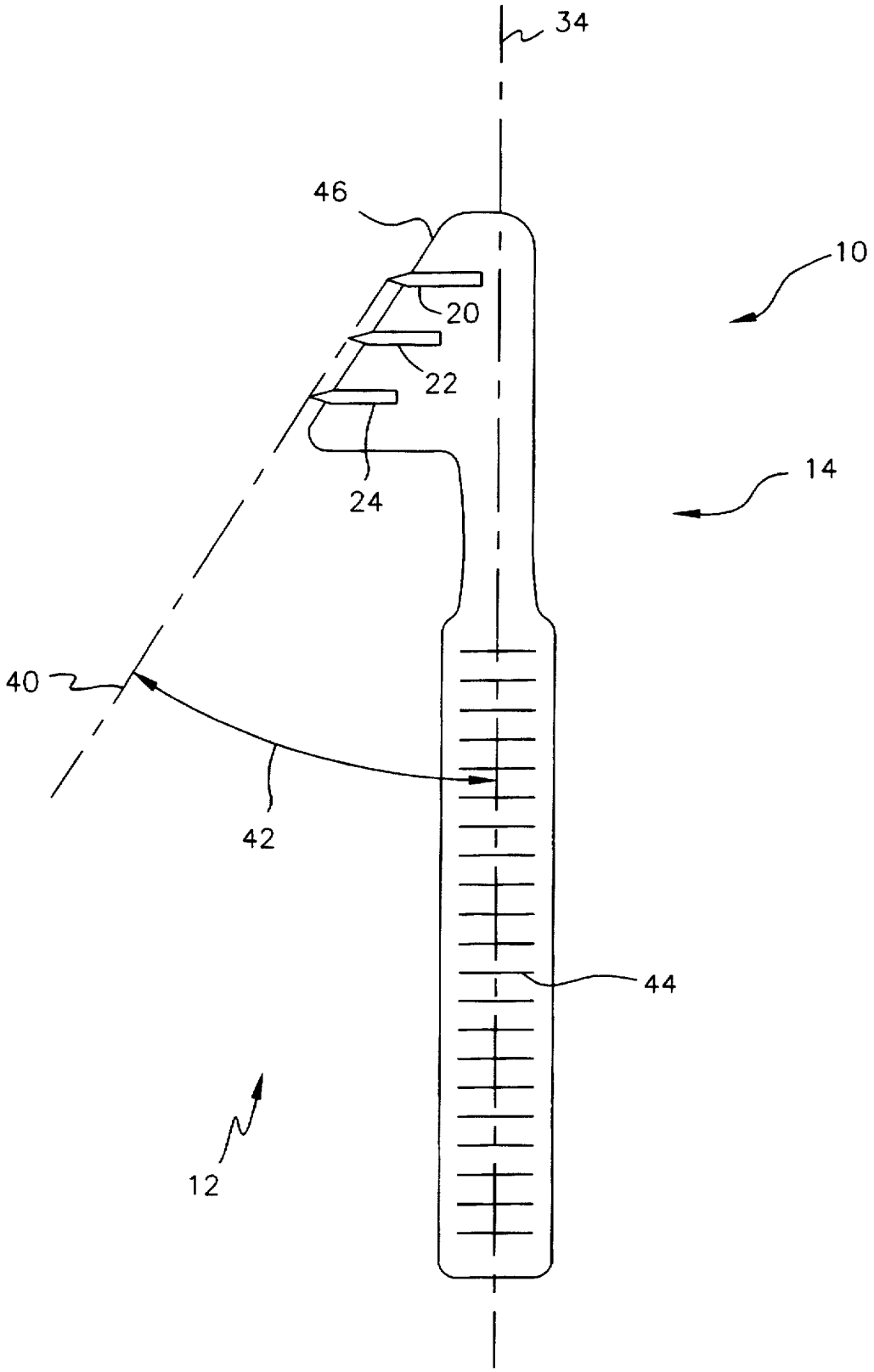
FIG. 2 is a right side elevational view of the invention.

Turning now to FIG. 2, cutting edges of blades 20, 22, 24 lie in a common plane, as indicated by projection line 40. This plane forms an angle 42 of approximately thirty degrees with axis 34 of handle 12. The actual magnitude of this angle will be selected as appropriate for achieving a natural hand position and wrist angle when shaving the face.

Obviously, the novel razor may include features of conventional hand held razors, such as ridging 44 on handle 12 to facilitate grip and a lubricated or smooth surface at 46 for comfort. Moreover, blades 20, 22, 24, which have been described hereinbefore as single blades, may each incorporate two blades (not shown) disposed in close proximity, as is known for achieving close, effective shaving.

Also, various modifications and variations may be introduced by those of skill in the art. Dimensions and proportions of razor 10 may be modified. Width of the head may be significantly less than that depicted in the drawings. A neck (not shown) spanning and connecting handle 12 and head 14 may be provided so as to space head 14 from handle 12 and angularly orient head 14 with respect to handle 12 as desired.

Head 14 has been diagrammatically represented, and may be modified to include features for releasably holding blades 20, 22, 24, so that blades 20, 22, and 24 may be individually or collectively renewed. Also, structure for influencing angular projection from head 14 may be provided if desired. A joint or the like for pivoting head 14 with respect to handle 12 may also be provided.

It is to be understood that the present invention is not limited to the embodiments described above, but encompasses any and all embodiments within the scope of the following claims.

I claim:

1. A hand held razor for shaving both large and small surface areas of the face, comprising:

an elongated handle;

a head having a top surface and a bottom surface, a plurality of blades including a first blade having a first length and a second blade having a second length different from that of said first blade, and further including a third blade of a length different from those of said first blade and said second blade, and holding structure for holding said plurality of blades in a parallel, spaced apart relationship occupying a common plane, said holding structure arranged to hold said blades in order of progressively increasing blade length as distance increases from said elongated handle.

2. The hand held razor according to claim 1, said blades each having a right end, said blades arranged within said head of said razor such that said right ends of said blades are aligned in a first straight line forming a thirty degree angle with said handle.

3. The hand held razor according to claim 2, said blades each having a left end, said blades arranged within said head of said razor such that said left ends of said blades are aligned in a second straight line forming a thirty degree angle with said handle and forming a vee with said first straight line formed by said right ends of said blades, each said blade being centered within said razor.

4. A hand held razor for shaving both large and small surface area of the face, comprising:

an elongated handle; and a head having a top surface and bottom surface, a plurality of blade including a first blade having a first length, a second blade having a second length different from that of said first blade, and a third blade having a third length different from those of said first blade and said second blade, and holding structure for holding said plurality of blades in parallel, spaced apart relationship occupying a common plane in order of progressively increasing blade length with the shortest blade disposed proximate said bottom surface of said head of said razor, said blades each having a right end, said blades arranged within said head of said razor such that said right ends of said blades are aligned in a first straight line forming a thirty degree angle with said handle, and said blades each having a left end, said blades arranged within said head of said razor such that said left ends of said blades are aligned in a second straight line forming a thirty degree angle with said handle and forming a vee with said first straight line formed by said right ends of said blades, each said blade being center within said razor.

* * * * *